United States Patent [19]

Sasaki et al.

[11] Patent Number: 4,542,091

[45] Date of Patent: Sep. 17, 1985

[54] COLOR IMAGE FORMING PROCESS

[75] Inventors: Noboru Sasaki; Takatoshi Ishikawa; Keiichi Adachi, all of Kanagawa, Japan

[73] Assignee: Fuji Photo Film Co., Ltd., Kanagawa, Japan

[21] Appl. No.: 681,741

[22] Filed: Dec. 14, 1984

[30] Foreign Application Priority Data

Dec. 15, 1983 [JP] Japan ..... 58-237068

[51] Int. Cl.[4] ..... G03C 5/30; G03C 7/16

[52] U.S. Cl. ..... 430/380; 430/383; 430/435; 430/468; 430/505; 430/507

[58] Field of Search ..... 430/505, 507, 383, 380, 430/435, 468, 250

[56] References Cited

U.S. PATENT DOCUMENTS

| | | | |
|---|---|---|---|
| 3,737,317 | 6/1973 | Nicholas et al. | 430/505 |
| 4,309,500 | 1/1982 | Shisido | 430/507 |
| 4,413,054 | 11/1983 | Mitsui et al. | 430/505 |
| 4,420,555 | 12/1983 | Krueger et al. | 430/507 |
| 4,456,681 | 6/1984 | Kadowaki et al. | 430/505 |

*Primary Examiner*—Mary F. Downey

*Attorney, Agent, or Firm*—Sughrue, Mion, Zinn, Macpeak and Seas

[57] ABSTRACT

A process for forming color images, and a silver halide color photographic material for use in the process, are described, said process comprising processing with a developer containing hydroxylamine a silver halide color photographic material comprising a support having thereon at least one red-sensitive silver halide emulsion layer, at least one green-sensitive silver halide emulsion layer, and at least one blue-sensitive silver halide emulsion layer, said blue-sensitive silver halide emulsion layer being disposed at a more upper portion than other color-sensitive silver halide emulsion layers, and said color photographic material further comprising (1) a light-insensitive layer containing at least one of a yellow colored magenta-dye-forming coupler and a yellow non-diffusible organic dye between the lowermost blue-sensitive silver halide emulsion layer and the uppermost layer of the other color-sensitive silver halide emulsion layers, and (2) a light-insensitive silver halide emulsion in any layer above said light-insensitive layer.

8 Claims, No Drawings

COLOR IMAGE FORMING PROCESS

FIELD OF THE INVENTION

This invention relates to a color image forming process. More particularly, the invention relates to a process for forming color images in silver halide color photographic materials using a developer containing hydroxylamine.

BACKGROUND OF THE INVENTION

It is well known that a developer for silver halide photographic materials generally contains at least a developing agent for reducing silver halide, a development accelerator, a preservative for preventing the occurrence of fatigue of the developer by oxidation, and an antifoggant. More particularly, the preservative prevents the developing agent from being oxidized by oxygen dissolved in the aqueous solution from the air, thus losing developing power, and sodium sulfite is most usually used as a preservative. However, when a large amount of sodium sulfite preservative is used in a developing agent for silver halide color photographic materials, coloring hindrance undesirably occurs. Therefore, for a developer for silver halide color photographic materials, hydroxylamine has been widely used as a preservative.

On the other hand, recently, it has been clarified that when iron ions enter the developer containing hydroxylamine, fogging of images is increased. This phenomenon is considered to be caused by ammonia generated by the catalystic action of the iron ions for the decomposition reaction of the hydroxylamine, and it has been reported that the problem can be overcome by adding 1,3-diamino-2-propanol-N,N,N',N'-tetraacetic acid to the developer as a chelating agent (P. J. Twist's report in *International Congress of Photographic Science,* (1982)). However, the improvement is insufficient.

Also, in color photographic materials, it is common to use a so-called DIR compound (development inhibitor releasing compound) capable of forming in the silver halide emulsion layers of the color photographic materials a development inhibitor in an amount corresponding to the coloring amount during the color development to improve the sharpness of the color film and the color reproducibility by the color correction effect.

In this case, however, if an antifoggant which is the released group of the DIR compound is accumulated in the developer, it undesirably reduces the sensitivity of the color photographic materials. Recently, for preventing the occurrence of environmental pollution, it is preferred to reduce the amounts of processing chemicals used in order to reduce the total amount of the waste processing solutions. However, in the foregoing case, it takes a long period of time to replace the developer in a development tank with a supplement solution, whereby the development inhibitor, which is the released group of the DIR compound, is accumulated to reduce the sensitivity (see Japanese Patent Application (OPI) No. 151944/82 (the term "OPI" as used herein refers to a "published unexamined Japanese patent application")).

It is known that such problems can be reduced by incorporating light-insensitive fine grain silver halide emulsions capable of trapping the foregoing development inhibitor precipitating in the developer, as described in Japanese Patent Application (OPI) No. 23228/75. However, the existence of such a light-insensitive fine grain silver halide increases the formation of fog when iron ions enter the developer containing hydroxylamine. It has also been confirmed that such an action is more striking in the case of existence of colloidal silver grains in a yellow filter having a physical activity causing physical development.

SUMMARY OF THE INVENTION

A first object of this invention is to provide a process for forming color images excellent in image sharpness and color reproducibility using a developer containing hydroxylamine.

A second object of this invention is to provide a silver halide color photographic material which can be stably developed using a developer containing hydroxylamine.

A third object of this invention is to provide a silver halide color photographic material which can be stably developed using a developer containing hydroxylamine and which is excellent in image sharpness and color reproducibility.

It has now been discovered that the foregoing objects can be attained by the present invention as set forth below.

That is, according to this invention, a process is provided for forming color images which comprises processing with a developer containing hydroxylamine a silver halide color photographic material comprising a support having thereon at least one red-sensitive silver halide emulsion layer, at least one green-sensitive silver halide emulsion layer, and at least one blue-sensitive silver halide emulsion layer, said blue-sensitive silver halide emulsion layer being disposed at a more upper portion than other color-sensitive silver halide emulsion layers, and said color photographic material further comprising (1) a light-insensitive layer (a yellow filter layer) containing at least one of a yellow colored magenta-dye-forming coupler and a yellow non-diffusible organic dye between the lowermost blue-sensitive silver halide emulsion layer and the uppermost layer of the other color-sensitive silver halide emulsion layers, and (2) a light-insensitive silver halide emulsion in any layer above said light-insensitive layer.

DETAILED DESCRIPTION OF THE INVENTION

It is preferred that the light-insensitive layer (1) or the yellow filter layer which is used in the color photographic material in this invention shows a low physical developing effect. Accordingly, it is preferred that the amount of colloidal silver which is ordinarily used for a yellow filter layer should be low. That is, in the case of this invention, wherein the use of colloidal silver grains functioning as a yellow filter as in the conventional technique is rather undesirable, the yellow filter effect is mainly obtained by means of at least one of a yellow magenta-dye-forming coupler and a yellow non-diffusible organic dye in place of colloidal silver grains. Also, in the case of containing colloidal silver in this invention, it is preferred that a color-mixing preventing agent such as hydroquinone is used together or a color-mixing preventing layers are formed in both sides of the yellow filter layer.

The yellow filter layer for use in this invention has an absorption maximum at a wavelength of from 420 to 480 nm and an optical density at 530 nm of not more than 0.3 times the optical density thereof at the absorption maximum wavelength in the coated state of the yellow filter layer. The optical density at the absorption maximum wavelength is preferably from 0.2 to 1.5, and more preferably 0.3 to 1.0.

Known yellow colored magenta-dye-forming couplers (hereinafter more simply referred to as yellow colored magenta couplers) can be used for the yellow filter in this invention, and examples of particularly preferred yellow colored magenta couplers are shown below.

D-1

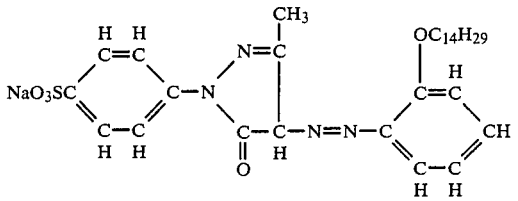

D-2

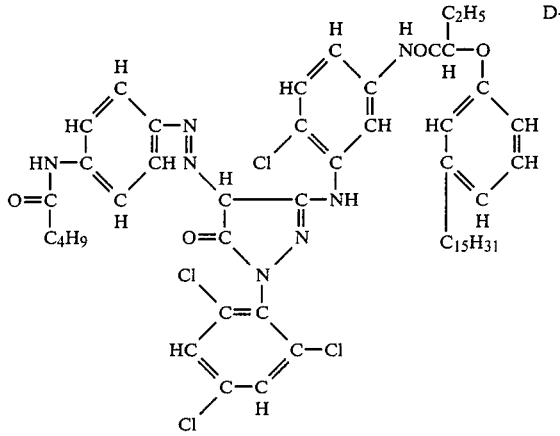

For introducing the foregoing yellow colored magenta coupler into the yellow filter layer for use in this invention, known methods for generally introducing couplers into silver halide emulsion layers, such as the method described, for example, in U.S. Pat. No. 2,322,027 can be used.

For example, the yellow colored magenta coupler is dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethylaurylamide, etc.), a fatty acid ester (e.g., dibutoxyethyl succinate, dioctyl azelate, etc.), a trimesic acid ester (e.g., tributyl trimesate, etc.), etc., or a low-boiling organic solvent having boiling point of about 30° C. to 150° C., such as a lower alkyl acetate (e.g., ethyl acetate, butyl acetate, etc.), ethyl propionate, secondary butyl alcohol, methyl isobutyl ketone, β-ethoxyethyl acetate, methylcellosolve acetate, etc., and then the solution of the yellow colored magenta coupler is dispersed in an aqueous hydrophilic colloid solution. A mixture of a high-boiling organic solvent and a low-boiling organic solvent may be used. Also, the dispersion method by polymers as described in Japanese Patent Publication No. 39853/76 and Japanese Patent Application (OPI) No. 59943/76 can be used.

When the yellow colored magenta coupler has an acid group such as carboxylic acid, sulfonic acid, etc., the coupler may be introduced in an aqueous hydrophilic colloid solution as an alkaline aqueous solution thereof.

The yellow non-diffusible organic dye for use in this invention can be selected from known dyes, but particularly preferred examples of these dyes are as follows.

D-3

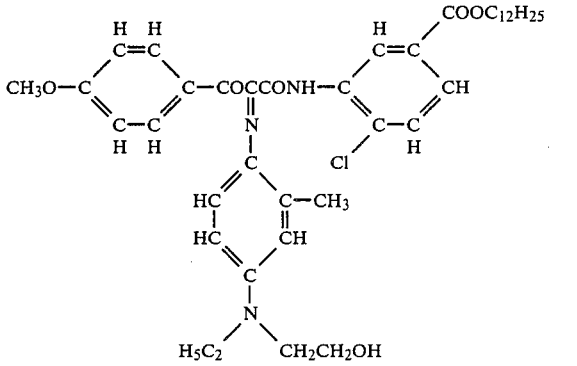

D-4

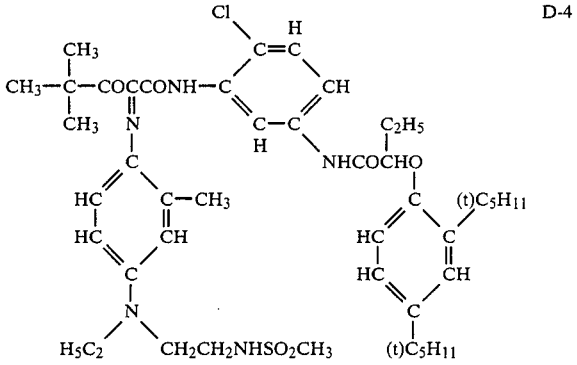

D-5

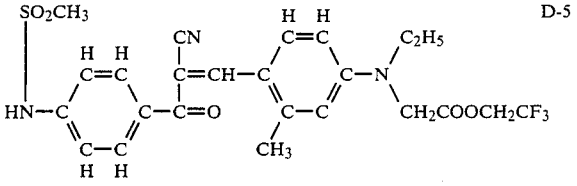

D-6

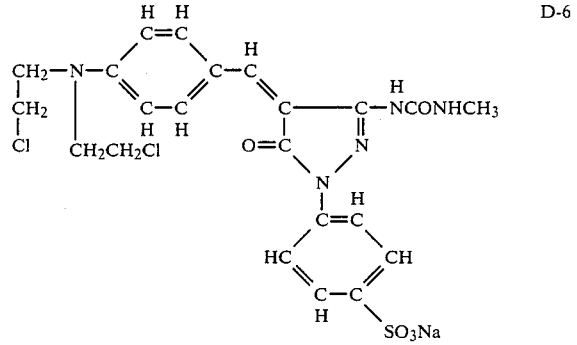

D-7

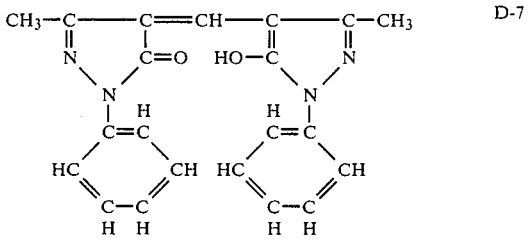

-continued

D-8

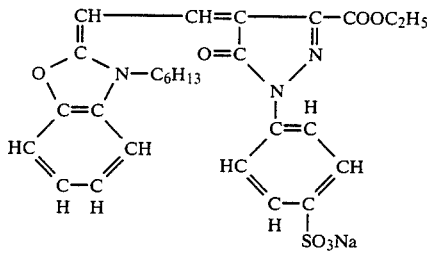

D-9

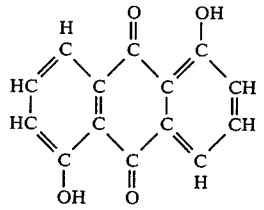

D-10

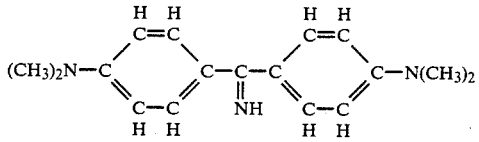

D-11

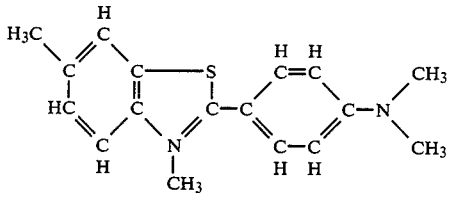

The yellow filter layer for use in the silver halide color photographic material which is processed in this invention may also be preparing using the foregoing organic dye by a known method. That is, when the organic dye is oil soluble, the organic dye can be introduced into an aqueous hydrophilic colloid solution in the same manner as the case of introducing the foregoing yellow colored magenta coupler as described above, and when the organic dye is water-soluble, the dye is introduced into a hydrophilic colloid solution as an aqueous solution thereof or an alkaline aqueous solution thereof.

The yellow filter layer may be also prepared using both the yellow colored magenta coupler and the organic dye together, if desired, with colloidal silver in the same manner as the case of preparing a colloidal silver-containing yellow filter layer. In this case, the contents of the yellow colored magenta coupler, the organic dye, and, if used, colloidal silver, are controlled so that the desired optical density as described hereinbefore is obtained.

The light-insensitive silver halide for use in this invention can be produced by an ordinary method, for example, the same method as in the preparation of the silver halide photographic emulsion as described hereinafter in this specification, and no chemical sensitization is applied so that the silver halide emulsion is not imparted with light sensitivity. Accordingly, it is preferred that the sensitivity of the light-insensitive silver halide emulsion not more than 1/10, and more preferably not more than 1/100, the sensitivity of the blue-sensitive silver halide emulsion layer having the lowest sensitivity among the color-sensitive silver halide emulsion layers.

It is preferred that the size of the light-insensitive silver halide grains be in the range of from about 0.05 to about 0.6 μm, and the amount thereof is 0.1 g/m$^2$ to 1 g/m$^2$, preferably 0.3 g/m$^2$ to 1 g/m$^2$ as the calculated silver amount.

In this invention, couplers for use in color photosensitive materials can be introduced in the silver halide emulsion layers by known methods, for example, the method described in U.S. Pat. No. 2,322,027. For example, the coupler is dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azerate, etc.), a trimesic acid ester (e.g., tributyl trimesate, etc.), etc., or a low-boiling organic solvent having a boiling point of about 30° C. to 150° C., such as a lower alkyl acetate (e.g., ethyl acetate, butyl acetate, etc.), ethyl propionate, secondary butyl alcohol, methyl isobutyl ketone, β-ethoxyethyl acetate, methylcellosolve acetate, etc., and then the solution is dispersed in an aqueous hydrophilic colloid solution. A mixture of the foregoing high-boiling organic solvent and the low-boiling organic solvent may be used. Also, the dispersion method by polymers described in Japanese Patent Publication No. 39853/76 and Japanese Patent Application (OPI) No. 59943/76 can be used.

When couplers have an acid group, such as carboxylic acid and sulfonic acid groups, they can be introduced into a hydrophilic colloid soluton as an alkaline aqueous solution thereof.

As the binder or protective colloid for photographic emulsions, gelatin is preferably used, but other hydrophilic colloids may also be used. Examples include gelatin derivatives, graft polymers of gelatin with other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; and various synthetic hydrophilic polymers or copolymers such as polyvinyl alcohol, partially acetalized polyvinyl alcohol, poly-N-vinylpyrrolidone, polyacrylic acid, polymethacrylic acid, polyvinylpyrazole, etc.

As gelatin, acid-treated gelatin, enzyme-treated gelatin as described in *Bull. Soc. Sci. Phot. Japan,* No. 16, page 30 (1966), and hydrolyzed products and enzyme-decomposition products of gelatin, as well as limed gelatin, can be useful. Useful gelatin derivatives include reaction products of gelatin and various compounds such as acid halides, acid anhydrides, isocyanates, bromoacetic acid, alkanesultones, vinylsulfonamides, maleinimides, polyalkylene oxides, epoxy compounds, etc. Practical examples of the gelatin derivatives are described, for example, in U.S. Pat. Nos. 2,614,928, 3,132,945, 3,186,846, 3,312,553, U.K. Pat. Nos. 861,414, 1,005,7894 1,033,189, Japanese Patent Publication No. 26845/67, etc.

Gelatin graft polymers which can be used in this invention include products prepared by grafting homopolymers or copolymers of vinylic monomers, such as acrylic acid, methacrylic acid, derivatives thereof (e.g., esters and amides), acrylonitrile, styrene, etc., to gelatin. In particular, the graft polymers of gelatin with polymers having some compatibility with gelatin, such as acrylic acid, methacrylic acid, acrylamide, methacrylamide, hydroxyalkyl methacrylate, etc., are preferred. Practical examples thereof are described in U.S. Pat. Nos. 2,763,625, 2,831,767, 2,956,884, etc.

Specific examples of the synthetic hydrophilic polymers which can be used in this invention are described, for example, in West German Patent Application (OLS) No. 2,312,708, U.S. Pat. Nos. 3,620,751, 3,879,205, Japanese Patent Publication No. 7561/68.

For the silver halide photographic emulsion layers of the silver halide color photographic materials for used in this invention, silver bromide, silver iodobromide, silver iodochloro-bromide, silver chlorobromide, or silver chloride may be used as the light-sensitive silver halide. A preferred light-sensitive silver halide is silver iodobromide containing not more than 15% silver iodide. A particularly preferred silver halide is silver iodobromide containing from 2 mole% to 12 mole% silver iodide.

There are no particular restrictions on the mean grain size ("grain size" as used herein means the diameter of the grains in the case of spherical or almost spherical grains, and the long side length in the case of cubic grains, which is based on the projected area) of the light-sensitive silver halide grains contained in the silver halide photographic emulsions, but the mean grain size is preferably less than 3 μm.

The grain size distribution may be narrow or wide.

The silver halide grains contained in the photographic emulsions for use in this invention may have a regular crystal form such as a cubic or octahedral form, or may have an irregular crystal form such as spherical or tabular form. The silver halide grains may also be a composite form these crystal forms or may be composed of a mixture of these crystal grains.

The silver halide grains may be composed of a different phase or a uniform phase in the inside and surface layers of the grains, or may be grains mainly forming a latent image on the surface thereof or grains mainly forming a latent image in the inside thereof.

The silver halide photographic emulsions of a fine grain emulsion or a photosensitive emulsion for used in this invention can be prepared by the methods described, for example, in P. Glafkides, *Chimie et Physique Photographique* (published in 1967 by Pual Montel), G. F. Duffin, *Photographic Emulsion Chemistry* (published in 1966 by Focal Press), and V. L. Zelikman et al, *Making and Coating Photographic Emulsion (published in* 1964 by Focal Press). That is, the silver halide emulsions may be prepared by an acid method, a neutralization method, an ammonia method, etc., and also the reaction of a soluble silver salt and a soluble halide may be performed by a one-side mixing method, a simultaneous mixing method, or a combination thereof.

The silver halide emulsions can also be prepared by a so-called back mixing method, i.e., a method of forming the grains in the presence of excessive silver ion. As one embodiment of the simultaneous mixing method, a so-called controlled double jet method, i.e., a method of maintaining a constant pAg in the liquid phase in which silver-halide grains are formed, can be used. According to this method, a silver halide emulsion in which the crystal form of the silver halide grains is regular and the grain sizes are almost uniform is obtained. Two or more kinds of silver halide emulsions prepared separately may be used as the mixture.

The light-sensitive silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

For removing soluble salts from the silver halide emulsions after the formation thereof or after the physical ripening thereof, a noodle method of washing with water after gelling the emulsion or a flocculation method utilizing an inorganic salt, an anionic surface active agent, an anionic polymer (e.g., polystyrenesulfonic acid) or a gelatin derivative (e.g., acylated gelatin, carbamoylated gelatin, etc.), etc., can be used.

The light-sensitive silver halide emulsions are usually chemical sensitized. The chemical sensitization can be performed using the method described, for example, in H. Frieser, *Die Grundlagen der Photographischen Prozess mit Silberhalogeniden,* pages 675–734 (Akademische Verlagsgesellschaft, 1968).

That is, useful chemical sensitization methods include a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a noble metal (e.g., gold complex salts and complex salts of metals belonging to group VIII of the periodic table, such as Pt, Ir, Pd, etc.). These methods can be used solely or as a combination thereof.

Practical examples of these methods are described, for example, in U.S. Pat. Nos. 1,574,944, 2,278,947, 2,410,689, 2,728,668, 3,656,955, etc., for the sulfur sensitization method; U.S. Pat. Nos. 2,419,974, 2,983,609, 4,054,458, etc., for the reduction sensitization method; and U.S. Pat. Nos. 2,399,083, 2,448,060, etc., U.K. Pat. No. 618,061, for the noble metal sensitization method.

The silver halide photographic emulsions for use in this invention can contain various compounds for preventing the formation of fog during the production, storage, or photographic processing of the photographic materials or stabilizing the photographic properties of the photographic materials. Such antifoggants and stabilizers include azoles such as benzothiazolium salts, nitroimidazoles, triazoles, benzotriazoles, benzimidazoles (in particular, nitro- or halogen-substituted products), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, etc.; the foregoing heterocyclic mercapto compounds having a water-solubilizing group such as a carboxy group and a sulfon group; thioketo compounds such as oxazolinethione, etc.; azaindenes such as triazaindenes, tetraazaindenes (in particular, 4-hydroxy-substituted (1,3,3a,7)tetraazaindenes), etc.; benzenethiosulfonic acids; benzenesulfinic acids; etc. More practical examples of these compounds and methods of using them are described, for example, in U.S. Pat. Nos. 3,954,474, 3,982,947, 4,021,248, and Japanese Patent Publication No. 28660/77.

The silver halide photographic emulsion layers and other hydrophilic colloid layers of the color photographic materials for use in this invention may contain various surface active agents as coating aids, for electrostatic prevention, for improving slidability, for improving dispersibility, for preventing adhesion and for improving various photographic properties (e.g., acceleration of development, contrast increase, sensitization, etc.). Examples of these surface active agents include nonionic surface active agents such as saponin (steroid series), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide-addition products of silicone, etc.); anionic surface active agents containing acid groups such as a carboxy group, a sulfo group, a phospho group, a sulfuric acid ester group, a phosphoric acid ester group, etc., for example, alkylcarboxylates, alkylsulfonates, alkylbenzenesulfonates, alkylnaphthalenesulfonates, alkylsulfonic acid esters, alkylphosphoric acid esters, N-acyl-N-alkyltaurines, sulfosuccinic acid esters, sulfoalkyl polyoxyethylenealkylphenyl ethers, polyoxyethylenealkylphosphoric acid esters, etc.; amphoteric surface active agents such as amino acids, aminoalkylsulfonic acids, aminoalkylsulfuric acid esters, aminoalkylphosphoric acid esters, alkylbetaines, amineoxides, etc.; and cationic surface active agents such as alkylamine salts, aliphatic or aromatic quaternary ammonium salts, heterocyclic quaternary ammonium salts (e.g., pyridinium, imidazolium, etc.), and phosphonium or sulfonium salts comprising aliphatic or heterocyclic rings.

The silver halide photographic emulsion layers of the photographic materials for use in this invention may further contain polyalkylene oxides or the derivatives thereof, such as ethers, esters, amines, etc., thereof; thioether compounds; thiomorpholines; quaternary ammonium salts; urethane derivatives, urea derivatives, imidazole derivatives, 3-pyrazolidones, etc., for increasing sensitivity and contrast, and for the acceleration of development. Examples of these compounds are described, for example, in U.S. Pat. Nos. 2,400,532, 2,423,549, 2,716,062, 3,617,280, 3,772,021, 3,808,003, U.K. Pat. No. 1,488,991, etc.

The color photographic materials for use in this invention may further contain a dispersion of a water-insoluble or water sparingly soluble synthetic polymer in the silver halide emulsion layers or other hydrophilic colloid layers for improving the dimensional stabilization, etc. As these synthetic examples, there are polymers composed of monomer components such as an alkyl (meth)acrylate, an alkoxyalkyl (meth)acrylate, glycidyl (meth)acrylate, (meth)acrylamide, a vinyl ester (e.g., vinyl acetate, etc.), acrylonitrile, olefin, styrene, etc., solely or combinations thereof, or combinations of these monomers and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc. Examples of these polymers are described, for example, in U.S. Pat. Nos. 2,376,005, 2,739,137, 2,853,457, 3,062,674, 3,411,911, 3,488,708, 3,525,620, 3,607,290, 3,635,715, 3,645,740, U.K. Pat. Nos. 1,186,699, 1,307,373, etc.

The color developer for use in this invention contains hydroxylamine. The hydroxylamine for use in this invention includes general hydroxylamines.

Hydroxylamines can be used in the form of free amine in the color developer, but are more generally used in the form of the water-soluble salt. General examples of the salt are sulfates, oxalates, hydrochlorides, phosphates, carbonates, acetates, etc. The hydroxylamines may be substituted or unsubstituted, and the nitrogen atom of the hydroxylamine may be substituted by an alkyl group.

Preferred hydroxylamines compounds can be represented by the formulae

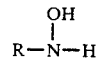

wherein R represents a hydrogen atom or an alkyl group having from 1 to 3 carbon atoms (preferably, an alkyl group of 1 to 3 carbon atoms, which may be substituted).

The foregoing compounds may be water-soluble salts. It is particularly preferred that R be a hydrogen atom. The addition amount of the compound is from 0.1 to 20 g, and preferably from 1 g to 10 g, per liter of the color developer.

Preferred examples of hydroxylamines which can be used in this invention are as follows.

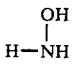
H-1

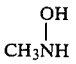
H-2

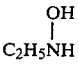
H-3

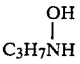
H-4

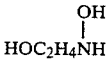
H-5

Also, the color developer contains an aromatic primary amine color developing agent of a type typically used in various color developing processes. Preferred examples of the color developing agent are p-phenylenediamine derivatives and typical examples are shown below but the invention is not limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-($\beta$-hydroxyethyl)amino]aniline
D-5: 2-Methyl-4-[N-ethyl-N-($\beta$-hydroxyethyl-)amino]aniline
D-6: N-Ethyl-N-($\beta$-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-$\beta$-ethoxyethylaniline
D-11: 4-Amino-3-methyl-N-ethyl-N-$\beta$-butoxyethylaniline Also, these p-phenylenediamine derivatives may be the form of salts such as sulfates, hydrochlorides, sulfites, p-toluenesulfonates, etc. These compounds are described, for example, in U.S. Pat. Nos. 2,193,015, 2,552,241, 2,566,271, 2,592,364, 3,656,950, 3,698,525, etc. The aromatic primary amine color developing agent is used at a concentration of from about 0.1 g to about 20 g, and preferably from about 0.5 g to about 10 g, per liter of the developer.

The pH of the developer for use in this invention is preferably from 9 to 12, and more preferably from 9 to 11.0.

Also, the color developer may further contain known components of color developers. For example, sodium hydroxide, potassium hydroxide, sodium carbonate, potassium carbonate, sodium tertiary phosphate, potassium tertiary phosphate, potassium metaborate, boric acid, etc., can be used as an alkali agent or a pH buffer solely, or as a combined function component. Also, various salts such as disodium hydrogenphosphate or dipotassium hydrogenphosphate, and potassium dihydrogenphosphate or sodium dihydrogenphosphate, and sodium bicarbonate or potassium bicarbonate, borates, alkali nitrate, alkali sulfate, etc., can be used for imparting a buffer function to the developer, for facilitating the preparation of the developer, or for increasing the ionic strength of the developer.

Also, the color developer may further contain a water softener. Examples include inorganic phosphates such as tetrapolyphosphates, tripolyphosphates, etc.; aminopolycarboxylic acid such as nitrilotriacetic acid, ethylenediaminetetraacetic acid, diethylenetriaminepentaacetic acid, etc.; and organic sulfonic acids such as 1-hydroxyalkylidene-1,1-diphosphoric acid, etc.

The color developer may further contains, if desired, a development accelerator such as the various pyrimidinium compounds as described, for example, in U.S. Pat. Nos. 2,648,604 and 3,171,247 and Japanese Patent Publication No. 9503/69; other cationic compounds, cationic dyes such as phenosafranine, etc; neutral salts such as thallium nitrate, potassium nitrate, etc.; polyethylene glycols and the derivatives thereof as described in Japanese Patent Publication No. 9304/69 and U.S. Pat. Nos. 2,531,832, 2,533,990, 2,577,127 and 2,950,970, etc.; nonionic compounds such as polythioether; organic solvents and organic amines as described in Japanese Patent Publication No. 9509/69 and Belgian Pat. No. 682,862, ethanolamine, ethylenediamine, diethanolamine, etc. Other examples of development accelerators are described in L. F. A. Mason, *Photographic Processing Chemistry,* pages 40–43 (Focal Press-London, 1966). Still other examples of the development accelerator are benzyl alcohol, phenylethyl alcohol, etc., described in U.S. Pat. No. 2,515,147 and pyridine, hydrazine, and amines described in *Nippon Shashin Gakkai Shi* (*Journal of The Society of Photographic Science and Technology of Japan*) Vol. 14, page 74 (1952). Also, the thioether series compounds described in U.S. Pat. No. 3,201,242 may be used as the development accelerator. Among these compounds, ethylenediamine, benzyl alcohol, and the thioether series compounds are particularly preferred.

Moreover, sodium sulfite, potassium sulfite, potassium hydrogensulfite, and sodium hydrogensulfide, which have been conventionally used as preservatives, may be added to the color developer in this invention, if desired.

Also, the color developer may, if desired, contain an antifoggant in this invention. As such an antifoggant, alkali metal halides such as potassium bromide, sodium bromide, potassium iodide, etc., and organic antifoggants can be used. Examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, hydroxyazaindolidine, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compound such as thiosalicyclic acid, etc. Particularly preferred compounds are nitrogen-containing heterocyclic compounds. These antifoggants may be dissolved and deposited in the color developer from the color photographic materials during processing.

In this invention, bleaching or blixing is applied after color development. The bleach solution or the blix solution contains iron ions as a bleaching agent. As the iron ions, an inorganic iron salt such as ferric chloride, potassium ferricyanate, etc.; an organic iron salt such as ferric citrate, ferric oxalate, etc.; and an aminocarboxylic acid iron complex salt such as ethylenediaminetetraacetic acid iron salt, etc., can be used.

The bleach solution or the blix solution may further contain various additives such as bleach accelerators as described in U.S. Pat. Nos. 3,042,520 and 3,241,966, Japanese Patent Publication Nos. 8506/70, 8836/70, etc., and thiol compounds as described in Japanese Patent Application (OPI) No. 65732/78.

In this invention, the bleach solution may be stirred by blowing. Stirring by blowing, the liquid scattered from the bleach solution frequently enter the developer and when conventional silver halide photographic materials which are liable to be physically developed are processed in conventional processing steps wherein the bleach solution contains an iron compound and the developer contains hydroxylamine, stirring by blowing inevitably increases the formation of fog and is not proper.

Also, the color photographic materials thus bleached are usually fixed and as the fixing agent, thiosulfates and thiocyanates as well as organic sulfur compounds which are known to have an effect as a fixing agent can be used. The fix solution may contain a water-soluble aluminum salt as a hardening agent.

As the developing process which can be employed in this invention, there are a developing process wherein coloring materials are incorporated in color photographic materials (i.e., coupler-in-emulsion type) as described in, e.g., U.S. Pat. Nos. 2,376,679, 2,322,027, and 2,801,171 and a developing process wherein coloring agents are incorporated in color developers (i.e., coupler-in-developer type) as described, for example, in U.S. Pat. Nos. 2,252,718, 2,592,243, and 2,590,970.

Also, a process may be employed in which a color developing agent is incorporated in the light-sensitive material, e.g., the silver halide emulsion layers and the light-sensitive materials are processed in an alkaline aqueous solution.

The silver halide photographic emulsion for use in this invention may be spectrally sensitized by methine dyes, etc. The dyes used for the purpose include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes.

Examples of useful sensitizing dyes are described, for example, in German Pat. No. 929,080, U.S. Pat. Nos. 2,493,748, 2,503,776, 2,519,001, 2,912,329, 3,656,959, 3,672,897, and 4,025,349, U.K. Pat. No. 1,242,588, and Japanese Patent Publication No. 14030/69.

These sensitizing dyes may be used solely or as a combination thereof. Combinations of sensitizing dyes are particularly used for supersensitization. Typical examples of supersensitization are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, U.K. Pat. No. 1,344,281, Japanese Patent Publication Nos. 4936/68, 12375/78, and Japanese Patent Application (OPI) Nos. 109925/77, 110618/77, etc.

For the silver halide emulsion layers of the color photosensitive materials for use in this invention, color-forming couplers, that is, the compounds capable of coloring by the oxidative coupling with an aromatic primary amine color developing agent (e.g., a phenylenediamine derivative or an aminophenol derivative) during color development may be used together with a polymer coupler latex.

For example, magenta couplers (i.e., magenta-dye-forming couplers) include 5-pyrazolone couplers, pyrazolobenzimidazole couplers, cyanoacetylcoumarone couplers, open-chain acylacetonitrile couplers, etc.; yellow couplers include acylacetoamido couplers (e.g., benzoylacetanilides, pyvaloylacetanilides, etc.), etc.; and cyan couplers include naphtholic couplers, phenolic couplers, etc.

These couplers are preferably rendered non-diffusible by having a hydrophobic group, referred to as a "ballast group", in the molecule.

These couplers may be four-equivalent or two-equivalent with respect to silver ion.

Also, colored couplers having a color correction effect or couplers releasing a development inhibitor with the progress of development (so-called DIR coupler) may be used in this invention. Furthermore, non-coloring DIR coupling compounds forming colorless coupling reaction products and releasing development inhibitors may be used.

Examples of the magenta couplers are described in U.S. Pat. Nos. 2,600,788, 2,983,608, 3,062,653, 3,127,269, 3,311,476, 3,419,391, 3,519,429, 3,588,319, 3,582,322, 3,615,506, 3,834,908 and 3,891,445; West German Pat. No. 1,810,464; West German Patent Application (OLS) Nos. 2,408,665, 2,417,945, 2,418,950 and 2,424,467; Japanese Patent Publication No. 6031/65; Japanese Patent Application (OPI) Nos. 74027/74, 4028/74, 129538/74, 60233/75, 159336/75, 20826/76, 26541/76, 42121/77, 58922/77, 55122/78, etc.

Examples of the yellow couplers are described in U.S. Pat. Nos. 2,875,057, 3,265,506, 3,408,194, 3,551,155, 3,582,322, 3,725,072 and 3,891,445; West German Patent No. 1,547,868; West German Patent Application (OLS) Nos. 2,219,917, 2,261,361, 2,414,006; U.K. Pat. No. 1,425,020; Japanese Patent Publication No. 10783/76; and Japanese Patent Application (OPI) Nos. 26133/72, 73147/73, 6341/75, 87650/75, 123342/75, 130442/75, 21827/76, 102636/76, 82424/77, 115219/77, etc.

Examples of the cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, and 4,004,929; West German Patent Application (OLS) Nos. 2,414,830, 2,454,329; Japanese Patent Application (OPI) Nos. 5055/73, 59838/73, 26034/76, 146828/76, 69624/77, 90932/77; etc.

Examples of the colored couplers which are used in this invention are described, for example, in U.S. Pat. Nos. 2,521,908, 3,034,892 and 3,476,560; Japanese Patent Publication Nos. 22335/63, 11304/67, 2016/69 and 32461/69; Japanese Patent Application (OPI) Nos. 26034/76 and 42121/77; West German Patent Application (OLS) No. 2,418,959, etc.

Examples of DIR couplers are described in U.S. Pat. Nos. 3,227,554, 3,617,291, 3,623,345, 3,701,783 and 3,790,384; West German Patent Application (OLS) Nos. 2,414,006; 2,454,301, and 2,454,329; U.K. Pat. No. 953,454; Japanese Patent Application (OPI) Nos. 122335/74 and 69624/77; Japanese Patent Publication No. 16141/76; etc.

In place of the DIR couplers, other compounds capable of releasing a development inhibitor may be incorporated in the photosensitive materials as described above, and such compounds are described, for example, in U.S. Pat. Nos. 3,297,445, 3,379,529; West German Patent Application (OLS) No. 2,417,914; Japanese Patent Application (OPI) Nos. 15271/77, 9116/78, etc.

The color photographic materials in this invention may further contain inorganic or organic hardening agents in the silver halide photographic emulsion layers or other hydrophilic colloid layers. Examples of such hardening agents include chromium salts (e.g., chromium alum, chromium acetate, etc.), aldehydes (e.g., formaldehyde, glyoxal, glutaraldehyde, etc.), N-methylol compounds (e.g., dimethylol urea, methyloldimethylhydantoin, etc.), dioxane derivatives (e.g., 2,3-dihydroxydioxane, etc.), active vinyl compounds (e.g., 1,3,5-triacryloxyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., and they can be used singly or as combinations thereof.

When the hydrophilic colloid layers contain dyes or ultraviolet absorbents in the photosensitive materials of this invention, the hydrophilic colloid layers may be mordanted by a cationic polymer, etc. Examples of such polymers are described, for example, in U.K. Pat. No. 685,475; U.S. Pat. Nos. 2,675,316, 3,839,401, 2,882,156, 3,048,487, 3,184,309, and 3,445,231; West German Patent Application (OLS) No. 1,914,362; Japanese Patent Application (OPI) Nos. 47624/75, 71332/75, etc.

The color photosensitive materials for use in this invention may further contain hydroquinone derivatives, aminophenol derivatives, gallic acid derivatives, ascorbic acid derivatives, etc., an anti-color-foggants.

The color photographic materials according to the present invention may further contain ultraviolet absorbents in the hydrophilic colloid layers. Examples of the ultraviolet absorbents are aryl group-substituted benzotriazole compounds, 4-thiazolidone compounds, benzophenone compounds, cinnamic acid ester compounds, butadiene compounds, benzoxazole compounds, and ultraviolet absorbing polymers. These ultraviolet absorbents may be fixed in the foregoing hydrophilic colloid layers.

Practical examples of the ultraviolet absorbents are described, for example, in U.S. Pat. Nos. 3,314,794, 3,352,681, 3,499,762, 3,533,794, 3,700,455, 3,705,805, 3,707,375 and 4,045,229; Japanese Patent Application (OPI) No. 2784/71; West German Patent Publication No. 1,547,863; etc.

The color photographic materials for use in this invention may further contain in the hydrophilic colloid layers water-soluble dyes as filter dyes or for irradiation prevention and examples of these water-soluble dyes include oxonol dyes, hemioxonol dyes, styryl dyes, merocyanine dyes, cyanine dyes, azo dyes, etc. Among these dyes, oxonol dyes, hemioxonol dyes, and merocyanine dyes are useful.

At the practice of invention, known fading preventing agents and also dye image stabilizers can be used, either singly or as combinations thereof. Examples of the fading preventing agents for use in this invention include hydroquinone derivatives, as described, for example, in U.S. Pat. Nos. 2,360,290, 2,418,613, 2,675,314, 2,701,197, 2,704,713, 2,710,801, 2,728,659, 2,732,300, 2,735,765 and 2,816,028; U.K. Patent 1,363,921, etc.; gallic acid derivatives as described in U.S. Pat. Nos. 3,069,262, 3,457,079, etc.; p-alkoxyphenols as described in U.S. Pat. Nos. 2,735,765 and 3,698,909; Japanese Patent Publication Nos. 20977/74, 6623/77, etc.; p-oxyphenol derivatives as described in U.S. Pat. Nos. 3,423,300, 3,573,050, 3,574,627 and 3,764,337; Japanese Patent Application (OPI) Nos. 35633/77, 147434/77 and 152225/77; and bisphenols as described in U.S. Pat. No. 3,700,455, etc.

As supports for the photographic materials according to the present invention, ordinarily used supports for photographic materials, such as cellulose nitrate films, cellulose acetate films, cellulose acetatebutyrate films, cellulose acetatepropionate films, polystyrene films, polyethylene terephthalate films, polycarbonate films, laminates of these films, thin glass films, papers, etc., can be used. Baryta-coated papers and papers coated or laminated with $\alpha$-olefin polymers, in particular, polymers of an $\alpha$-olefin having 2 to 10 carbon atoms, such as polyethylene, polypropylene, an ethylene-butene copolymer, etc., may be also used. Furthermore, plastic films having a surface which is roughened, for improving adhesion to other polymers, as described in Japanese Patent Publication No. 19068/72, can be advantageously used. Such supports may be colored by dyes or pigments. The supports may be blackened for the purpose of light shielding. These supports are generally subjected to a subbing treatment for improving the adhesion of the silver halide photographic emulsion layers. Furthermore, the surface of the support may be subjected to corona discharging treatment, ultraviolet irradiation treatment, flame treatment, etc., before or after the subbing treatment.

In the color photographic materials for use in this invention, the silver halide photographic emulsion layers or other hydrophilic colloid layers may further contain the whitening agent such as stilbene series, triazine series, oxazole series or coumarin series. The whitening agent may be water-soluble or water-insoluble; in the latter case, the whitening agent is used as a dispersion.

In the case of exposing the silver halide color photosensitive materials for use in this invention, the exposure time of 1/1000 sec. to 1 sec. for in-camera exposure can be routinely employed but an exposure time shorter than 1/1000 sec., for example, $1/10^4$ to $1/10^6$ sec. in case of using a xenon flash lamp or a cathode ray tube can be used, or an exposure time longer than 1 sec. can be used. If desired, the spectral composition of the light used for the exposure can be controlled using a color filter. Also, laser light can be used for the exposure. Still further, the photographic materials can be exposed by the light emitted from fluorescent substances which is excited by electron rays, X-rays, $\gamma$-rays, $\alpha$-rays, etc.

According to this invention, stable development can be performing using a hydroxylamine which is excellent as a preservative, whereby good image quality of the color photographs obtained can always be obtained. In particular, in the case of stirring by blowing a processing solution in the bleaching process, which is performed immediately after development. Fe-EDTA used for bleaching is usually scattered into the developer, but according to the present invention, stable development can be performed even in such a case. Thus, the significance of this invention is great.

The invention is further explained in detail by the following examples, but the invention is not limited to these examples.

EXAMPLE 1

A comparison sample 101 of multilayer color photosensitive material was prepared by forming the following layers on a cellulose triacetate film support.

| | |
|---|---|
| A 1st layer: Antihalation layer | |
| A gelatin layer containing | |
| Black colloidal silver | 0.18 g/m$^2$ |
| Ultraviolet absorbent C-1 | 0.12 g/m$^2$ |
| Ultraviolet absorbent C-2 | 0.17 g/m$^2$ |
| A 2nd layer: Intermediate layer | |
| A gelatin layer containing | |
| 2,5-Di-t-pentadecylhydroquinone | 0.18 g/m$^2$ |
| Coupler C-3 | 0.11 g/m$^2$ |
| Silver iodobromide emulsion (silver iodide 1 mole %, mean grain size: 0.07 $\mu$m) Silver coverage as the calculated silver content | 0.15 g/m$^2$ |
| A 3rd layer: 1st red-sensitive emulsion layer | |
| A gelatin layer containing | |
| Silver iodobromide emulsion (silver iodide 6 mole %, mean grain size 0.5 $\mu$m) Silver coverage as the calculated silver ccntent | 0.72 g/m$^2$ |
| Sensitiving Dye I | $7.0 \times 10^{-5}$ mole per mole of silver |
| Sensitizing Dye II | $2.0 \times 10^{-5}$ mole per mole of silver |
| Sensitizing Dye III | $2.8 \times 10^{-4}$ mole per mole of silver |
| Sensitizing Dye IV | $2.0 \times 10^{-5}$ mole per mole of silver |
| Coupler C-4 | 0.093 g/m$^2$ |
| Coupler C-5 | 0.31 g/m$^2$ |
| Coupler C-6 | 0.01 g/m$^2$ |
| A 4th layer: 2nd red-sensitive emulsion layer | |
| A gelatin layer containing | |
| Silver iodobromide emulsion (silver iodide 10 mole %, mean grain size 1.2 $\mu$m) Silver coverage as the calculated silver content | 1.2 g/m$^2$ |
| Sensitizing Dye I | $5.2 \times 10^{-5}$ mole per mole of silver |
| Sensitizing Dye II | $1.5 \times 10^{-5}$ mole per mole of silver |
| Sensitizing Dye III | $2.1 \times 10^{-4}$ mole per mole of silver |
| Sensitizing Dye IV | $1.5 \times 10^{-5}$ mole per mole of silver |
| Coupler C-4 | 0.10 g/m$^2$ |
| Coupler C-5 | 0.061 g/m$^2$ |
| Coupler C-7 | 0.046 g/m$^2$ |
| A 5th layer: 3rd red-sensitive emulsion layer | |
| A gelatin layer containing | |
| Silver iodobromide emulsion (silver iodide 10 mole %, mean grain size 1.8 $\mu$m) Silver coverage as the calculated silver content | 2.0 g/m$^2$ |
| Sensitizing Dye I | $5.5 \times 10^{-5}$ mole |

-continued

| | |
|---|---|
| | per mole of silver |
| Sensitizing Dye II | $1.6 \times 10^{-5}$ mole per mole of silver |
| Sensitizing Dye III | $2.2 \times 10^{-5}$ mole per mole of silver |
| Sensitizing Dye IV | $1.6 \times 10^{-5}$ mole per mole of silver |
| Coupler C-5 | 0.044 g/m$^2$ |
| Coupler C-7 | 0.16 g/m$^2$ |
| Coupler C-15 | 0.001 g/m$^2$ |
| A 6th layer: Interlayer | |
| A gelatin layer | |
| A 7th layer: 1st green-sensitive emulsion layer | |
| A gelatin layer containing Silver iodobromide emulsion (silver iodide 5 mole %, mean grain size 0.4 μm) Silver coverage as the calculated silver content | 0.55 g/m$^2$ |
| Sensitizing Dye V | $3.8 \times 10^{-4}$ mole per mole of silver |
| Sensitizing Dye VI | $3.0 \times 10^{-5}$ mole per mole of silver |
| Sensitizing Dye VII | $1.2 \times 10^{-4}$ mole per mole of silver |
| Coupler C-8 | 0.29 g/m$^2$ |
| Coupler C-9 | 0.04 g/m$^2$ |
| Coupler C-10 | 0.055 g/m$^2$ |
| Coupler C-11 | 0.058 g/m$^2$ |
| A 8th layer: 2nd green-sensitive emulsion layer | |
| A gelatin layer containing Silver iodobromide emulsion (silver iodide 6 mole %, mean grain size Silver coverage as the calculated 1.2 μm) Silver coverage as the calculated silver content | 1.0 g/m$^2$ |
| Sensitizing Dye V | $2.7 \times 10^{-4}$ mole per mole of silver |
| Sensitizing Dye VI | $2.1 \times 10^{-5}$ mole per mole of silver |
| Sensitizing Dye VII | $8.5 \times 10^{-5}$ mole per mole of silver |
| Coupler C-8 | 0.25 g/m$^2$ |
| Coupler C-9 | 0.013 g/m$^2$ |
| Coupler C-10 | 0.009 g/m$^2$ |
| Coupler C-11 | 0.011 g/m$^2$ |
| A 9th layer: 3rd green-sensitive emulsion layer | |
| A gelatin layer containing Silver iodobromide emulsion (silver iodide 10 mole %, mean grain size 1.8 μm) Silver coverage as the calculated silver content | 1.5 g/m$^2$ |
| Sensitizing Dye V | $3.0 \times 10^{-4}$ mole per mole of silver |
| Sensitizing Dye VI | $2.4 \times 10^{-5}$ mole per mole of silver |
| Sensitizing Dye VII | $9.5 \times 10^{-5}$ mole per mole of silver |
| Coupler C-9 | 0.013 g/m$^2$ |
| Coupler C-12 | 0.070 g/m$^2$ |
| Coupler C-16 | 0.001 g/m$^2$ |
| A 10th layer: Yellow filter layer | |
| A gelatin layer containing Yellow colloidal silver | 0.054 g/m$^2$ |
| 2,5-Di-t-pentadecylhydroquinone | 0.031 g/m$^2$ |
| A 11th layer: 1st blue-sensitive emulsion layer | |
| A gelatin layer containing Silver iodobromide emulsion (silver iodide 5 mole %, mean grain size 0.3 μm) Silver coverage as the calculated silver content | 0.32 g/m$^2$ |
| Coupler C-13 | 0.68 g/m$^2$ |
| Coupler C-14 | 0.03 g/m$^2$ |
| A 12th layer: 2nd blue-sensitive emulsion layer | |
| A gelatin layer containing Silver iodobromide emulsion (silver iodide 5 mole %, mean grain size 0.8 μm) Silver coverage as the calculated silver content | 0.29 g/m$^2$ |
| Sensitizing Dye VIII | $2.2 \times 10^{-4}$ mole per mole of silver |
| Coupler C-13 | 0.22 g/m$^2$ |
| A 13th layer: Fine grain emulsion layer | |
| A gelatin layer containing Silver iodobromide emulsion (silver iodide 2 mole %, mean grain size 0.15 μm) Silver coverage as the calculated silver content | 0.4 g/m$^2$ |
| A 14th layer: 3rd blue-sensitive emulsion layer | |
| A gelatin layer containing Silver iodobromide emulsion (silver iodide 14 mole %, mean grain size 1.8 μm) Silver coverage as the calculated silver content | 0.79 g/m$^2$ |
| Sensitizing Dye VIII | $2.3 \times 10^{-4}$ mole per mole of silver |
| Coupler C-13 | 0.19 g/m$^2$ |
| A 15th layer: 1st protective layer | |
| A gelatin layer containing Ultraviolet absorbent C-1 | 0.14 g/m$^2$ |
| Ultraviolet absorbent C-2 | 0.22 g/m$^2$ |
| A 16th layer: 2nd protective layer | |
| A gelatin layer containing Polymethyl methacrylate particles (diameter 1.5 μm) | 0.05 g/m$^2$ |

Each layer described above further contained a gelatin hardening agent C-17 and a surface active agent in addition to the foregoing components. Thus, sample 101 was prepared.

The compounds used for preparing the sample are shown below.

C-1

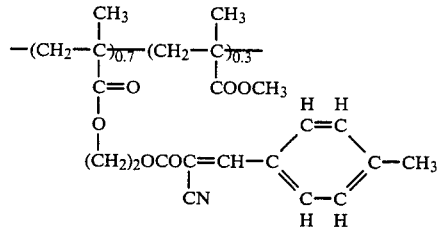

C-2

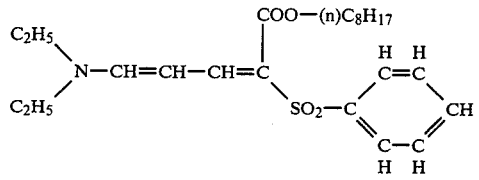

-continued
C-3
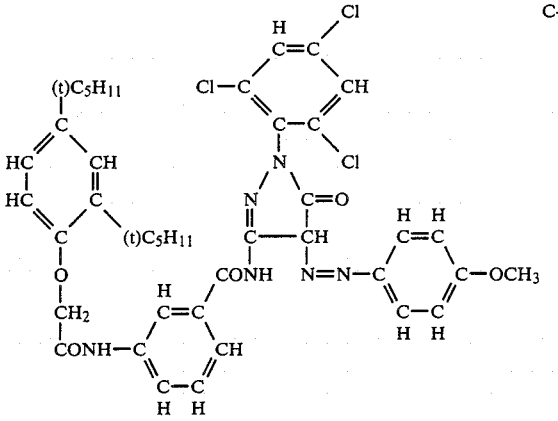
C-4
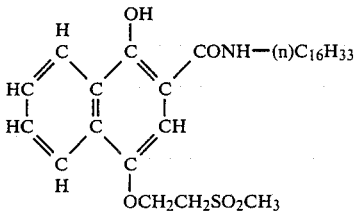
C-5
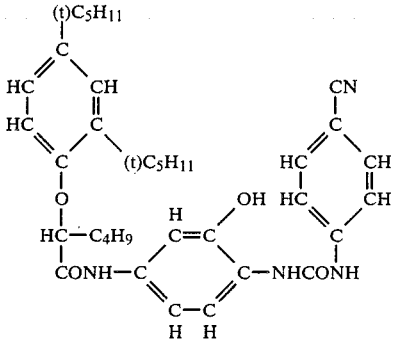
C-6
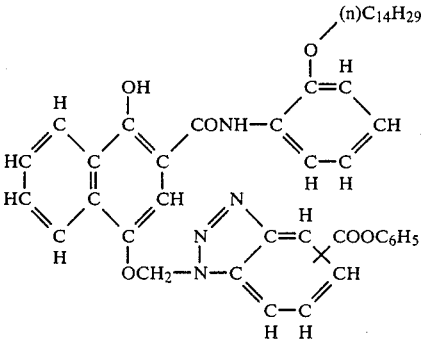
C-7
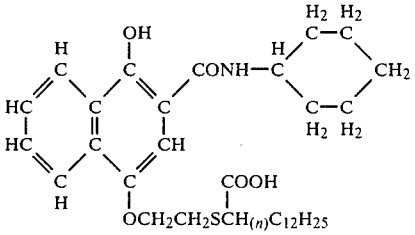
-continued
C-8
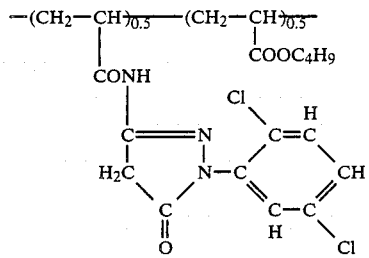
C-9
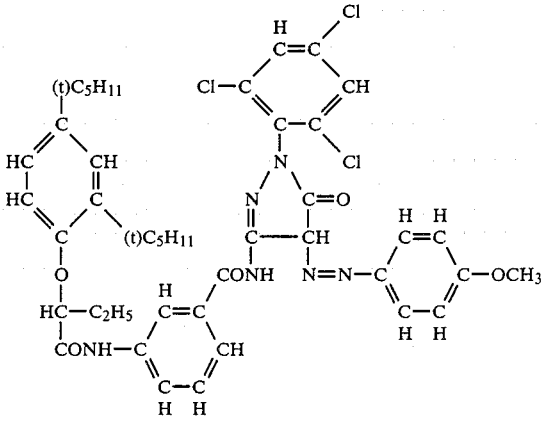
C-10
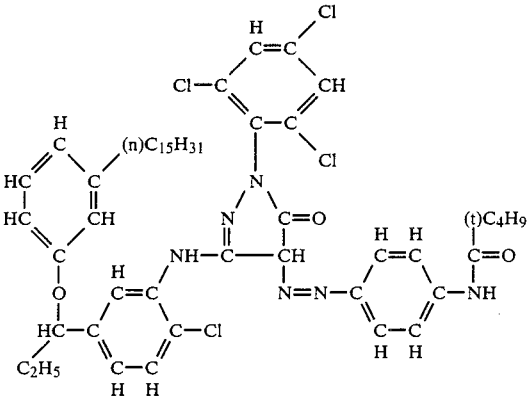
C-11
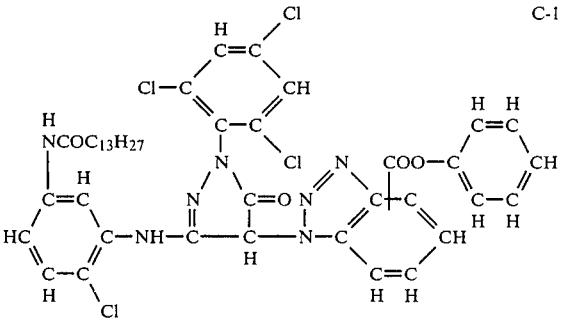

-continued
C-12
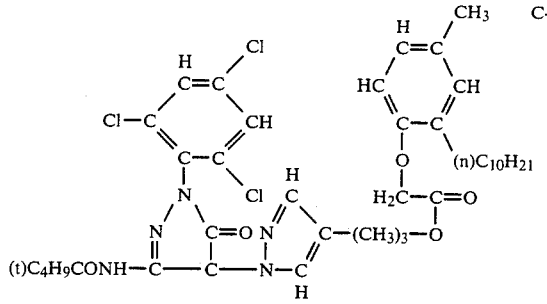
C-13
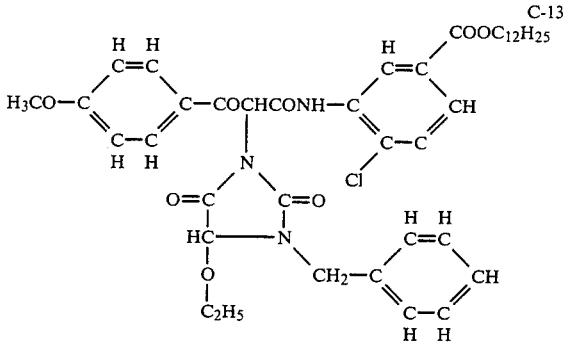
C-14
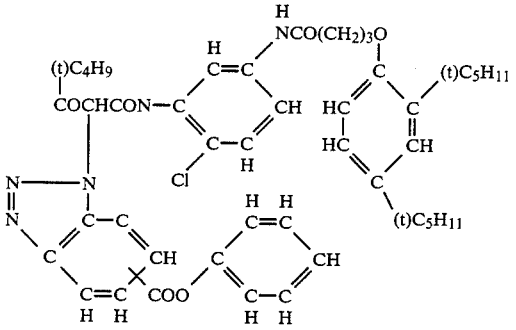
C-15
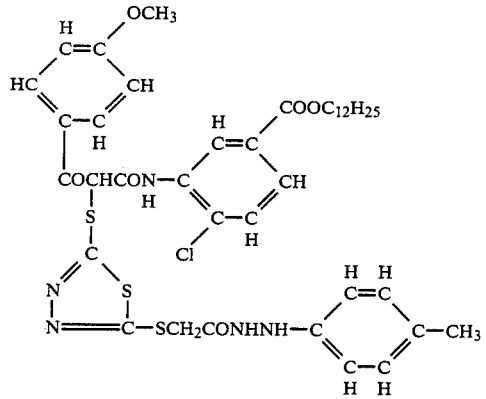
-continued
C-16
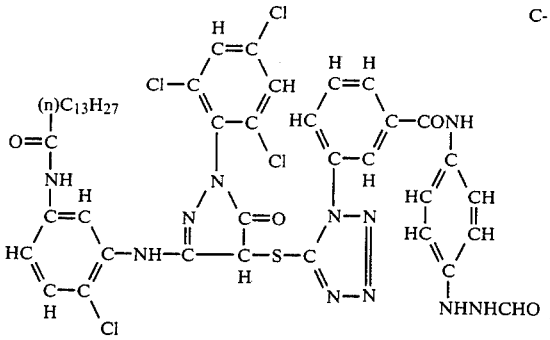
C-17
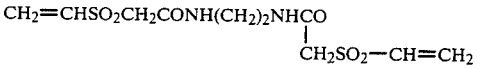
Sensitizing dye I
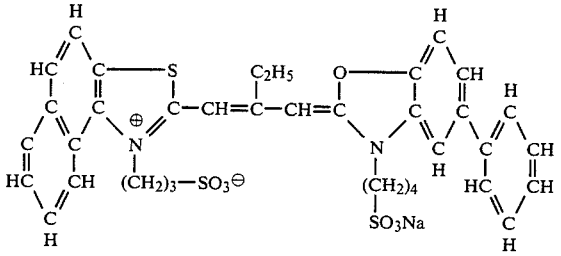
Sensitizing dye II
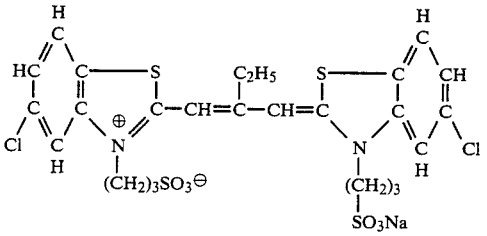
Sensitizing dye III
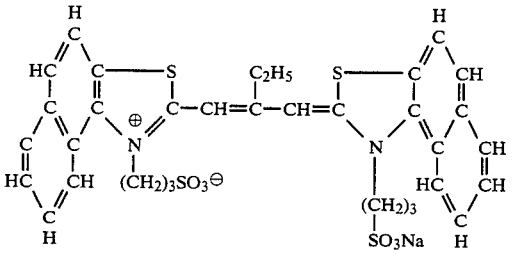
Sensitizing dye IV
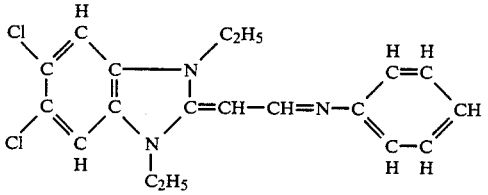
Sensitizing dye V -continued

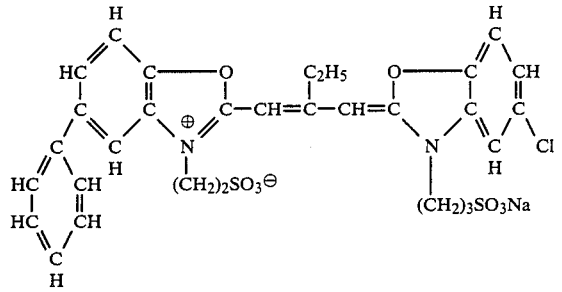

Sensitizing dye VI

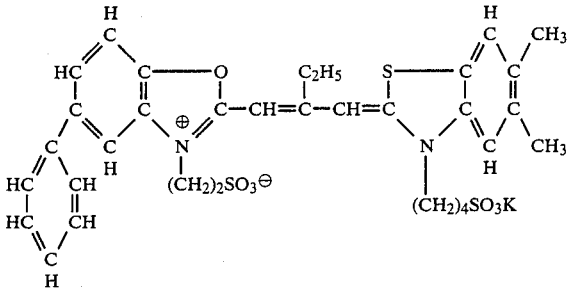

Sensitizing dye VII

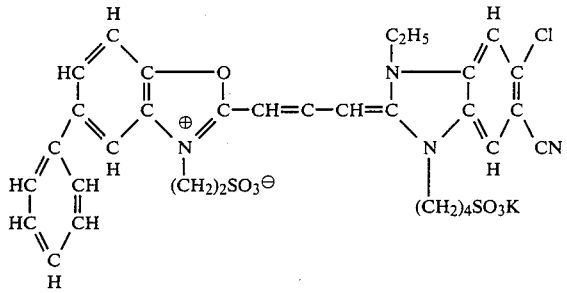

Sensitizing dye VIII

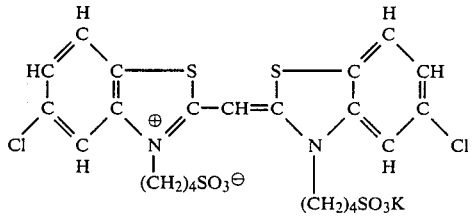

Preparation of Sample 102

By following the same procedure as in the case of preparing Sample 101, except that a dispersion of yellow colored magenta coupler (D-2) in oil was used at a coverage of 0.23 g/m$^2$ for the 10th layer in place of yellow colloid silver, Sample 102 was prepared.

Preparation of Samples 103 to 105

By following the same procedure as in the case of preparing Sample 102, except using an aqueous solution of organic dye (D-3), (D-6), or (D-8) at a coverage of 0.31 g/m$^2$, 0.10 g/m$^2$, or 0.10 g/m$^2$, respectively, in place of the dispersion of the yellow colored magenta coupler (D-2), Samples 103 to 105 were prepared.

Each of Samples 101 to 105 was wedge exposed to white light, and processed using an ordinary processing solution (I) as described below. The photographic properties thus obtained were almost same for each sample.

The processing solution (I) were as followed and were performed at 38° C.

| | |
|---|---|
| 1. Color development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing solutions used in the above processing process were as follows.

| | |
|---|---|
| Color developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleach solution: | |
| Ammonium bromide | 160.0 g |
| Aqueous ammonia (28%) | 25.0 cc |
| Ethylenediamine-tetraacetic acid sodium iron salt | 130.0 g |
| Glacial acetic acid | 14.0 cc |
| Water to make | 1 liter |
| Fix solution: | |
| Sodium tetrapolyphosphate | 2.0 g |
| Sodium sulfite | 4.0 g |
| Ammonium thiosulfate (70%) | 175.0 cc |
| Sodium hydrogensulfite | 4.6 g |
| Water to make | 1 liter |
| Stabilization solution | |
| Formalin | 8.0 cc |
| Water to make | 1 liter |

Each of the above-described samples was also processed using processing solution (III) as described below. Processing Solution (III): In processing solution (I), 20 ppm of ferric hydroxide was added to the color developer and the color developer was stored for one week at room temperature.

The results of processing the samples by two kinds of the development processes as described above are shown in Table 1. The result of Table 1 show that the photosensitive materials of this invention cause neither a reduction in sensitivity nor an increase of image fog, even in the case of using processing solution (III).

TABLE 1

| | Processing Solution | Blue-Sensitivity | Fog of Blue Sensitive Layer | Green-Sensitivity | Fog of Green Sensitive Layer | Red-Sensitivity | Fog of Red-Sensitive Layer |
|---|---|---|---|---|---|---|---|
| Sample 101 | I | 100 | 0.20 | 100 | 0.15 | 100 | 0.12 |
| (Comparison) | III | 85 | 0.50 | 90 | 0.30 | 100 | 0.12 |
| Sample 102 | I | 100 | 0.18 | 100 | 0.15 | 100 | 0.12 |
| (Present | III | 100 | 0.20 | 100 | 0.15 | 100 | 0.12 |

TABLE 1-continued

| | Processing Solution | Blue-Sensitivity | Fog of Blue Sensitive Layer | Green-Sensitivity | Fog of Green Sensitive Layer | Red-Sensitivity | Fog of Red-Sensitive Layer |
|---|---|---|---|---|---|---|---|
| Invention) | | | | | | | |
| Sample 103 | I | 100 | 0.19 | 98 | 0.15 | 100 | 0.12 |
| (Present Invention) | III | 100 | 0.19 | 98 | 0.15 | 100 | 0.12 |
| Sample 104 | I | 100 | 0.21 | 101 | 0.14 | 100 | 0.12 |
| (Present Invention) | III | 100 | 0.21 | 101 | 0.14 | 100 | 0.12 |
| Sample 105 | I | 100 | 0.18 | 105 | 0.16 | 100 | 0.12 |
| (Present Invention) | III | 100 | 0.18 | 105 | 0.16 | 100 | 0.12 |

EXAMPLE 2

Preparation of Sample 201 (Comparison sample)

By following the same procedure as in the case of preparing Sample 101, except that the fine grain emulsion and the silver halide emulsion were removed from the 13th layer and the 16th layer, respectively, of Sample 101, Comparison Sample 201 was prepared.

Preparation of Sample 202

By following the same procedure as in the case of preparing Sample 103 of Example 1 except that the fine grain emulsion and the silver halide emulsion were removed from the 13th layer and the 16th layer, respectively, Sample 202 was prepared.

Each of the foregoing samples was processed by processing process I, III, or processing solution (II) having the following composition. Processing solution (II): In the processing solution (I), $5\times10^{-5}$ mole/liter of a development inhibitor (C-19) which is the releasable group of the DIR coupler (C-18) described in Japanese Patent Publication No. 34933/80 was added to the color developer.

C-18

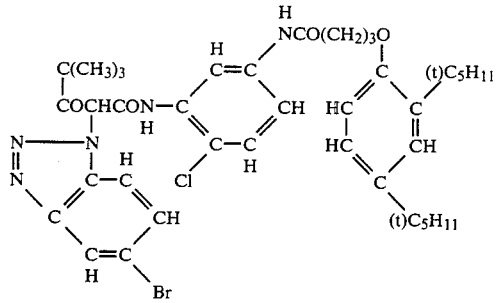

C-19

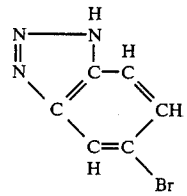

TABLE 2

| | Processing Solution | Blue-Sensitivity | Fog of Blue-Sensitive Layer | Green-Sensitivity | Fog of Green Sensitive Layer | Red-Sensitivity | Fog of Red-Sensitive Layer |
|---|---|---|---|---|---|---|---|
| Sample 201 | I | 90 | 0.18 | 100 | 0.15 | 100 | 0.12 |
| (Comparison) | II | 75 | 0.15 | 90 | 0.13 | 100 | 0.12 |
| | III | 70 | 0.35 | 95 | 0.25 | 100 | 0.12 |
| Sample 202 | I | 90 | 0.17 | 100 | 0.15 | 100 | 0.12 |
| (Present | II | 72 | 0.16 | 90 | 0.15 | 100 | 0.12 |
| Invention) | III | 90 | 0.17 | 100 | 0.15 | 100 | 0.12 |

The results thus obtained are shown in Table 2. The results of Table 2 show that in the case of the present invention, the development could be stably performed in either the case of the presence of iron ions or in the absence of iron ions.

The compounds used for the color developer in the processing solution (II) are shown below.

While the invention has been described in detail and with reference to specific embodiments thereof, it will be apparent to one skilled in the art that various changes and modifications can be made therein without departing from the spirit and scope thereof.

What is claimed is:

1. A process for forming color images which comprises processing with a developer containing hydroxylamine a silver halide color photographic material comprising a support having thereon at least one red-sensitive silver halide emulsion layer, at least one green-sensitive silver halide emulsion layer, and at least one blue-sensitive silver halide emulsion layer, said blue-sensitive silver halide emulsion layer being disposed at a more upper portion than other color-sensitive silver halide emulsion layers, and said color photographic material further comprising (1) a light-insensitive layer containing at least one of a yellow colored magenta-dye-forming coupler and a yellow non-diffusible organic dye between the lowermost blue-sensitive silver halide emulsion layer and the uppermost layer of the other color-sensitive silver halide emulsion layers, and (2) a light-insensitive silver halide emulsion in any layer above said light-insensitive layer.

2. A process for forming color images as in claim 1, wherein said light-insensitive layer has an absorption maximum at a wavelength of from 420 to 480 nm and an optical density at 530 nm of not more than 0.3 times the optical density thereof at the absorption maximum wavelength in the coated state of the light-insensitive layer.

3. A process for forming color images as in claim 2, wherein said light-insensitive layer has the optical density of from 0.2 to 1.5 at the absorption maximum wavelength.

4. A process for forming color images as in claim 2, wherein said light-insensitive layer has the optical density of from 0.3 to 1.0 at the absorption maximum wavelength.

5. A process for forming color images as in claim 1, wherein said hydroxylamine is represented by the

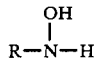

wherein R represents a hydrogen atom or an alkyl group having from 1 to 3 carbon atoms.

6. A process for forming color images as in claim 5, wherein said substituted R represents a hydrogen atom.

7. A process for forming color images as in claim 1, wherein the hydroxylamine is contained in the developer in an amount of from 0.1 to 20 g per liter of the color developer.

8. A process for forming color images as in claim 7, wherein the hydroxylamine is contained in the developer in an amount of from 1 to 10 g per liter of the color developer.

* * * * *